United States Patent [19]

Erard

[11] Patent Number: 4,982,388

[45] Date of Patent: Jan. 1, 1991

[54] APPARATUS DIAL AND WATCH

[76] Inventor: Raoul-Henri Erard, Chalet 4, 2300 La Chaux-de-Fonds, Switzerland

[21] Appl. No.: 252,131

[22] Filed: Oct. 3, 1988

[30] Foreign Application Priority Data

Oct. 1, 1987 [CH] Switzerland ..... 3812/87

[51] Int. Cl.[5] ..... G04B 19/06

[52] U.S. Cl. ..... 368/223; 368/228

[58] Field of Search ..... 368/223–239, 368/184

[56] References Cited

U.S. PATENT DOCUMENTS

| | | | |
|---|---|---|---|
| Re. 29,486 | 12/1977 | Wein | 368/35 |
| 2,011,517 | 8/1935 | Geoffrion | 368/223 |
| 3,665,701 | 5/1972 | Burdet | 368/295 |
| 3,999,298 | 12/1976 | Nishimura | 368/10 |
| 4,244,038 | 1/1981 | Ganter et al. | 368/35 |
| 4,823,329 | 4/1989 | Schwer et al. | 368/107 |

FOREIGN PATENT DOCUMENTS

| | | | |
|---|---|---|---|
| 2015446 | 11/1970 | Fed. Rep. of Germany . | |
| 2112012 | 6/1972 | France . | |
| 88000 | 2/1921 | Switzerland . | |
| 339887 | 9/1959 | Switzerland | 368/233 |
| 378232 | 7/1964 | Switzerland | 368/233 |
| 1152567 | 9/1969 | Switzerland . | |
| 195673 | 5/1976 | Switzerland . | |

*Primary Examiner*—Bernard Roskoski

*Attorney, Agent, or Firm*—Young & Thompson

[57] ABSTRACT

Apparatus comprising a dial provided with distinct zones formed by crown sectors 2.1, 2.2 and 2.3 which are adjustable in function of a manual correction device respectively of a selecting device.

10 Claims, 4 Drawing Sheets

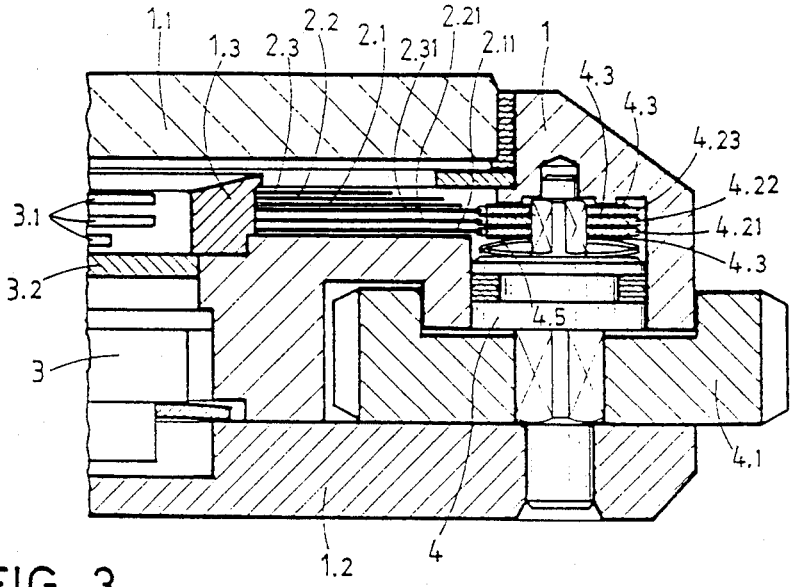
FIG. 3
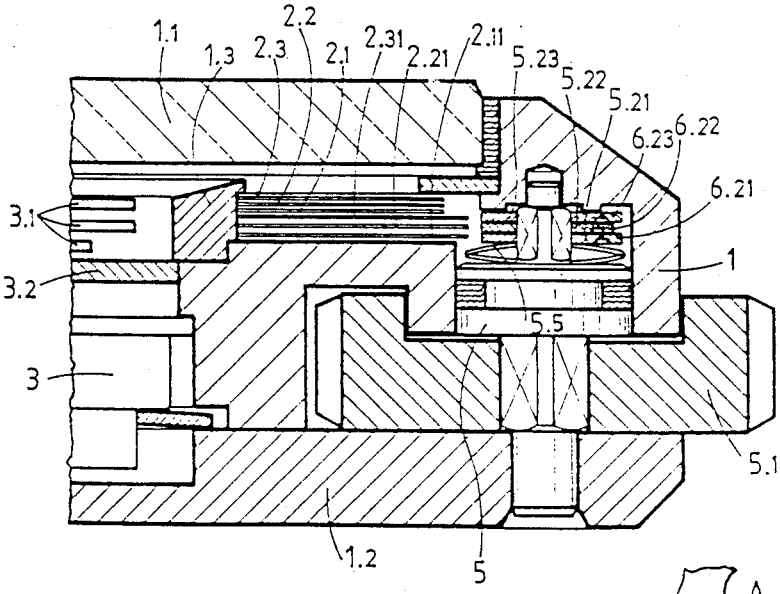
FIG. 4
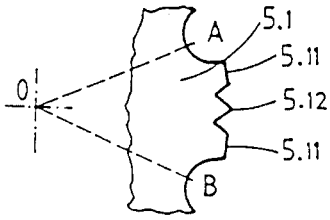

APPARATUS DIAL AND WATCH

There are different analogic measuring apparatuses comprising at least one hand which displaces in front of a dial and a revolving ring. Swiss patent No. CH-585 424, relating more particularly to a watch, describes an apparatus permitting to program at will a succession of events in function of the time, however, the modification of the programs necessitates a relatively complicated manipulation, what renders impossible certain corrections or particular applications during the program.

In order to obviate these drawbacks, the object of the invention is an apparatus comprising a dial formed, at least partially, by means of at least two distinct crowns, which are identical, concentric to the hands, radially split, the one passing through the slot of the other so that it is partially superimposed to it and determines two crown sectors forming particular zones of the dial, each crown being fast, through a radial periph arm which is near the slot, with a concentric control crown which is able to be driven by a manual corrector, on the one hand, simultaneously with the other crown in order to change the disposition of the sectors without modifying them, or on the other hand, when the other crown is maintained still by means of a selecting device, so as to modify the angular value of at least one sector which it determines.

The most important applications relate, on the one hand, to apparatuses having a fixed or revolving ring enabling to indicate a certain number of parameters and on the other hand, to certain apparatuses for which the aesthetical aspect and the possibility to modify this aspect is essential.

FIGS. 1, 2, 3 and 4 show respectively cross-sections in perspective and in plan of a first embodiment formed by a watch.

The possibility of using certain characteristics of the specification, alone or in combination, is preserved in order to elaborate any new claim capable of reinforcing the protection.

Figure 1:
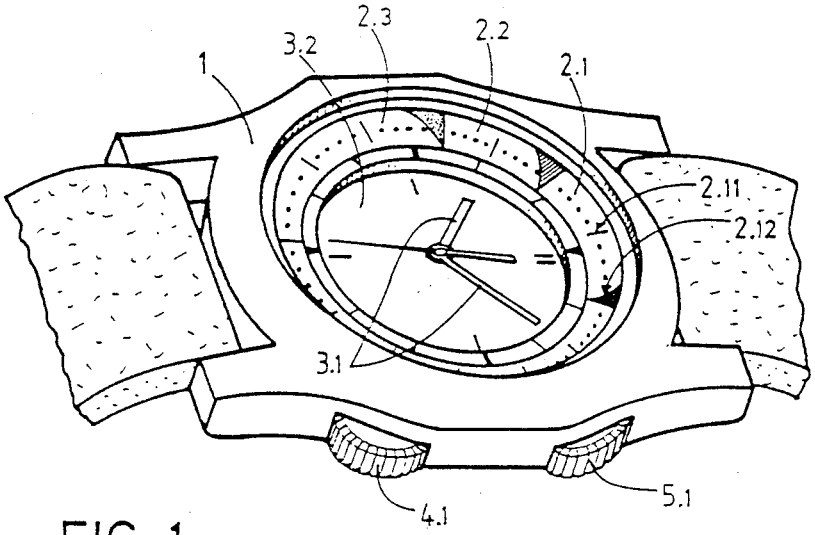

On FIG. 1, one sees under the crystal of the case 1, the hands 3.1 displacing above the dial 3.2 in front of a revolving inside ring the visible face of which is formed by particular zones determined by the sectors 2.1, 2.2 and 2.3 of different colors comprising each a particular identification mark 2.12 as well as a graduation 2.11. Each sector is fast with a control crown which can be driven by the handling crown of the manual corrector 4.1 whereas the handling crown of the selecting device 5.1 enables to select any time which sector has to be maintained still in the position it occupies. The selecting device enables a certain number of combinations from the simultaneous displacement, at the same speed, of all sectors enabling to modify their disposition with respect to the central dial without modifying the angular value of each of them, up to the total immobilization of all the sectors, providing safety in case of undesired handling of the central crown of the manual corrector.

Figure 2:
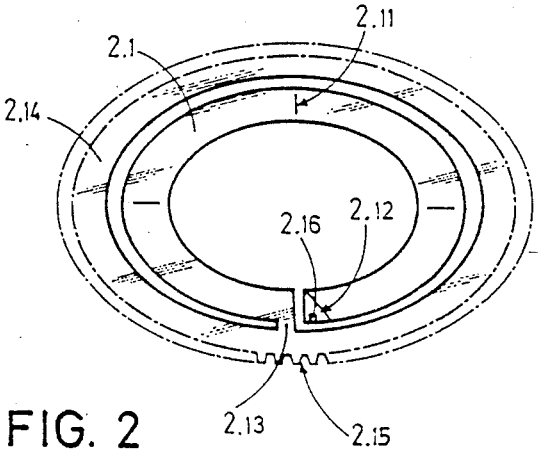

On FIG. 2, one sees the crown 2.1, the sector face 2.1 of which is colored and the free end of which determined by the radial slot comprises the particular identification mark 2.12 as well as a retaining bug 2.16, extending perpendicularly, whereas the other end is fast, by means of a radial arm 2.13 near the slot, with a concentric control crown 2.14 comprising a toothing 2.15, the whole being made in one piece and of a very small thickness (of the order of 0.05 mm.) enabling a resilient deformation of the crown, into a helical shape to permit the passage into the slot of the other complementary crowns in order to form the different desired sectors.

On FIG. 3, one sees the three crowns 2.1, 2.2 and 2.3 which are superimposed (helically imbricated) fast with the respective control crowns 2.11, 2.21 and 2.31 fitted by means of the summit of their toothing a cylindrical housing of the casing-ring located under the crystal 1.1 and maintained inwardly by means of a shoulder 1.3 surrounding the hands 3.1 and the dial 3.2 carried by the movement 3. The handling crown 4.1 is fast with the correcting shaft 4 the upper end of which has a square around which are fitted, alternately, correcting pinions 4.3 having a cylindrical hole, separated and driven by friction by means of correcting washers 4.21, 4.22 and 4.23 with square holes, under the resilient action of the spring washer 4.5, the said correcting washers being larger than the total diameter of the pinion in order to surround each respective toothing of the control crown so that they always remain in mesh despite their small width. The bottom of the casing 1.2 is fixed against the casing-ring and comprises the inside bearing of the correcting shaft and it is formed in such a way that it constitutes also a protection member for the handling crown. The handling crown is greater than the periphery of the casing-ring in order to facilitate its manual control to drive at the same speed all the crowns provided none of them is maintained still by the selection device which may fix a correcting pinion by the penetration of a lock in its toothing. When the selecting device maintains all the crowns still, it constitutes a security member avoiding any displacement of the crowns during an unwanted action on the handling crown. On the other hand it is possible to have the driving of at least one crown at a different speed by modifying the concerned gear ratio, this in order to obtain a different angular displacement in function of a given parameter.

On FIG. 4 one sees the handling crown of the selector 5.1 fast with the selecting shaft 5, identical to the driving shaft, but the upper square of which carries and drives three superimposed crowns 5.21, 5.22 and 5.23 working respectively with the control ends of the selecting locks 6.21, 6.22 and 6.23 working as well positioning springs in order to control the freeing or the locking of the different crowns according to the predetermined possibilities. The periphery of the handling crowns of the selector comprises a symbolic characteristic toothing 5.11 and 5.12 giving an indication relating to the selected functions.

In this first embodiment the angular displacement of each crown is limited in one direction up to the moment where the arm comes to rest against the arm of an adjacent crown, which it then drives, or in the other direction, when a retaining pin rests also against a member of an adjacent crown to prevent it from leaving the slot.

In certain cases, it can be necessary to ensure a total independence between the different crowns, that is why a derived second embodiment is described here below.

Figure 5:
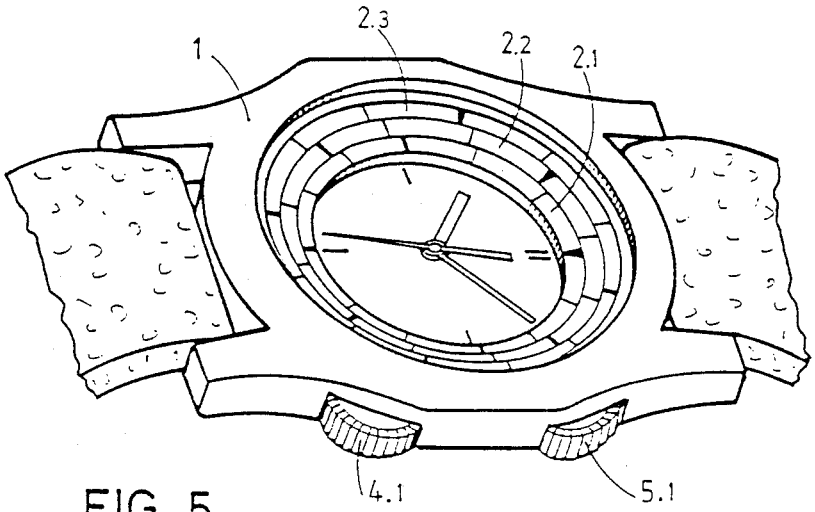
FIGS. 5 and 6 show in the same way a second embodiment derived from the first one.
Figure 6:
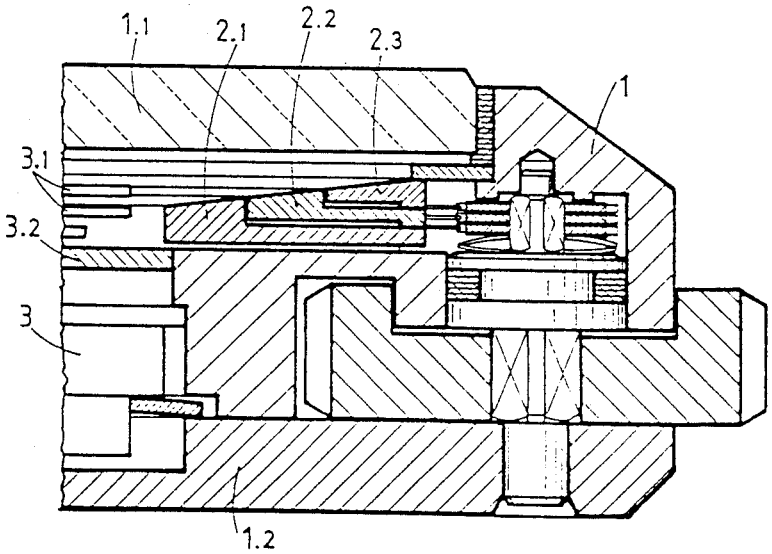

On FIGS. 5 and 6 one sees three crowns 2.1, 2.2 and 2.3, each being made in one piece with a toothed control crown meshing with a pinion of the manual corrector fast with the handling crown 4.1 the selecting functions being always defined by means of the handling crown of the selector 5.1.

The embodiments described can also be used as board instruments or any counters, the graduations can as well be replaced by indications or symbols, the function being then more the reading of a given indication than the angular determination of a given sector.

Finally the crowns can constitute a revolving casing-ring, which is complementary and independent from a central dial, the said revolving casing-ring being able to be placed on the case or on a board panel concentrically to the case.

Figure 7:
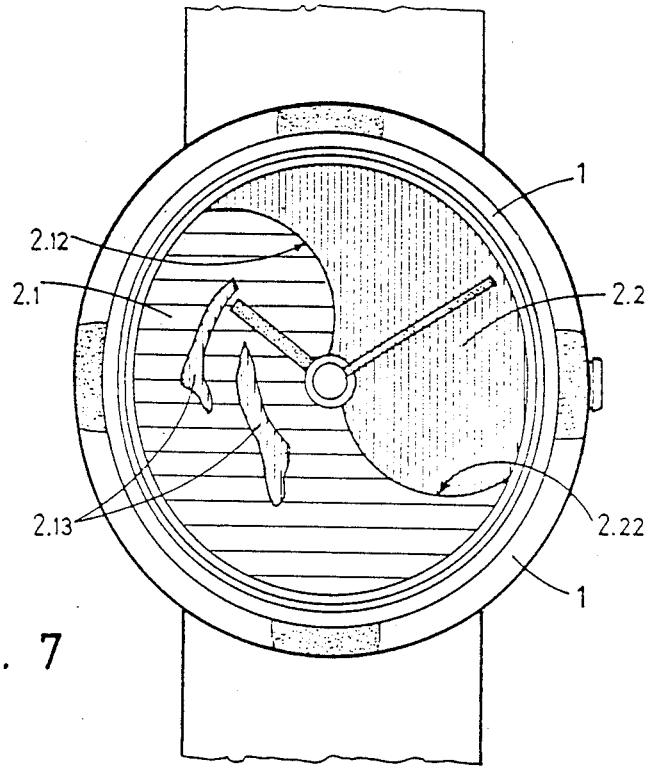
FIGS. 7 and 8 show in cross-section and in plan view a third embodiment.
Figure 8:
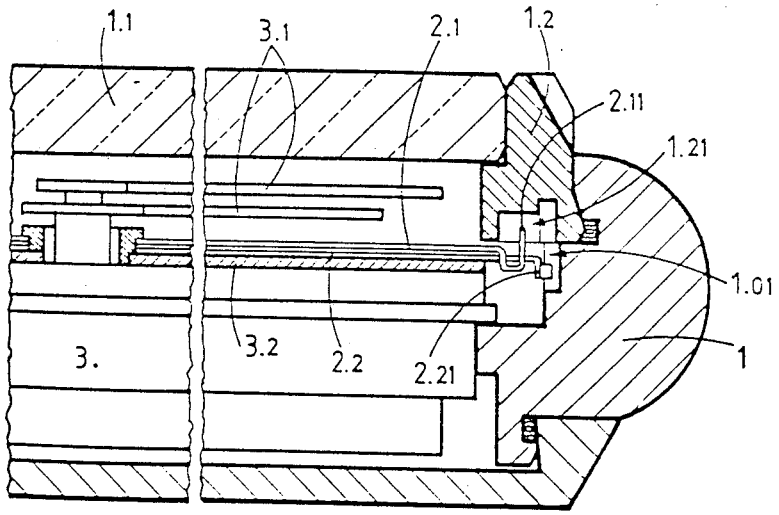

On FIGS. 7 and 8 there is shown the case 1 on which a control casing-ring 1.2 is pivoted carrying the crystal 1.1 and comprising a housing 1.21 in which the arm 2.11 of the crown 2.1 is fitted, the slot of which 2.12 extends along an arc of circle from the center of the dial up to its periphery so that a second identical crown 2.2 shaped by the edge of the slot 2.22, of a different color, determines a particular aesthetic of the dial. This second crown comprises an arm provided with a spring lock which is able to enter into one of the housings 1.01 of the casing-ring forming a selecting and fixing device of it when the first crown displaces with respect to it and provided the two respective arms are not in contact, since then the two crowns are simultaneously displaced enabling to adjust angularly the position of the second crown with respect to the case, then by actuating the control casing-ring in the opposite direction, to displace only the first crown in order to obtain the wanted aesthetical effect. It is possible to vary at will the outlook of the dial, the crowns pivoting around the control lug fast with a dial plate 3.2 assembled to the movement 3.

The crowns can be shaped to present apertures through which the face of the lower crown is visible. These crowns can be very thin (of the order of 0.05 mm.) and made by electro-forming or chemical attack opening many possibilities for their appearance (thin slots), different patterns) and the coloration of the faces and the printing of a design appearing in a hole enables to realize a fancy dial or note-book (display of a selected symbol in a hole), or a game using the possibility to control through the casing-ring the variation of the graphical appearance of the dial.

I claim:

1. In an apparatus for analogic measurement, comprising at least one indicator hand rotatable relative to a dial about an axis, said dial being constituted at least in part by at least two separate dial crowns which are concentric to said axis and are radially slotted, one said dial crown passing through the slot of the other dial crown such that the dial crowns are partially superposed thereby to define plural dial crown sectors constituting distinct zones of the dial; the improvement in which each dial crown has a radially extending arm thereon, a control crown concentric to said axis, said arm interconnecting the dial crown to the control crown, and a manually operable adjustment member engageable with at least one said control crown to modify the angular position of the dial crown which is connected by a said arm to said at least one control crown.

2. Apparatus as claimed in claim 1, wherein the dial is comprised by several dial crowns of different colors but of identical shape, each dial crown being integral with an associated said control crown via a said arm, each control crown having teeth engaging teeth on said manually operable correction member.

3. Apparatus according to claim 2, there being a plurality of said manually operable members in the form of pinions carried by a single correcting shaft perpendicular to the plane of the dial, all said pinions being rotatable at the same angular speed so as simultaneously to change the angular position of the various dial crowns relative to said at least one hand, and manual latch means for selectively stopping at least one said dial crown thereby to change the relationship of the dial crowns to each other.

4. Apparatus according to claim 3, wherein said manual latch means comprises a latch for all the control crowns thereby to prevent accidental actuation of the correction member.

5. Apparatus according to claim 1, wherein the dial crowns constitute arcs encircling a central dial.

6. Apparatus as claimed in claim 1, comprising a casing having a front face which is constituted by a movable dial crown supporting a transparent crystal and comprising a connection element rendering the movable dial crown fast with the radial arm of one of the dial crowns of which it constitutes the control crown as well as the manually operable adjustment member.

7. Apparatus according to claim 1, wherein one said dial crown is normally fixed, having an angular position determined by its said slot, its radial arm comprising a resilient connection element bearing against a cylindrical wall of an internal recess within a casing for the apparatus whose wall constitutes the control crown, said connection element being adapted to slide in the recess when its radial arm is urged by the radial arm of an adjacent crown which thus drives the first-mentioned crown in rotation and modifies the angular position of its slot.

8. Apparatus according to claim 1, the dial crowns having different decorative motifs thereon.

9. Apparatus as claimed in claim 1, one said dial crown having at least one opening through which appears a lower dial crown.

10. Apparatus according to claim 1, comprising a timepiece in the form of a watch.

* * * * *